United States Patent [19]

Lentz et al.

[11] 4,249,058

[45] Feb. 3, 1981

[54] FEED SYSTEM FOR A MICROWAVE OVEN

[75] Inventors: Ronald R. Lentz, Wayzata; Eldon J. Klemp, Mayer, both of Minn.

[73] Assignee: Litton Systems, Inc., Beverly Hills, Calif.

[21] Appl. No.: 50,707

[22] Filed: Jun. 21, 1979

[51] Int. Cl.[3] ..... H05B 6/74

[52] U.S. Cl. ..... 219/10.55 F

[58] Field of Search ..... 219/10.55 F, 10.55 R, 219/10.55 D, 10.55 M

[56] References Cited

U.S. PATENT DOCUMENTS

| | | | |
|---|---|---|---|
| 3,364,332 | 1/1968 | Reftmark | 219/10.55 F |
| 3,526,737 | 9/1970 | Black | 219/10.55 F |
| 3,758,737 | 9/1973 | Ironfield | 219/10.55 F |
| 3,991,295 | 11/1976 | Akiyoshi | 219/10.55 F |
| 4,065,654 | 12/1977 | Moore | 219/10.55 F |
| 4,173,716 | 11/1979 | Takahashi | 219/10.55 F |

*Primary Examiner*—Arthur T. Grimley

*Attorney, Agent, or Firm*—Robert E. Lowe; Nate F. Scarpelli

[57] ABSTRACT

An improved feed system for a microwave oven, including a shelf mounting a microwave energy source and a shelf extension protruding not more than half-way into the microwave cavity. The shelf extension acts as a microwave launching portion and includes a pair of adjacent cut-out sections with arcuate perimeters matching the rotational arc circumscribed by a pair of rotating stirrer blades. Alternative embodiments of the shelf extension - microwave launching portion are illustrated and described.

11 Claims, 4 Drawing Figures

FEED SYSTEM FOR A MICROWAVE OVEN

This invention relates to microwave ovens and in particular to an improved feed system for such ovens.

BACKGROUND OF THE INVENTION

As is known, microwave ovens incorporate a magnetron as a microwave energy source feeding or propagating energy into a resonant cavity, with the food to be cooked being placed within the cavity. The feed system includes means for optimally coupling and distributing energy from the magnetron to the cavity. It is of course desirable to obtain a good energy distribution, or as commonly known in the trade a good cooking pattern, so as to minimize any "hot spots" or "cold spots" in the oven.

Various attempts have been made over the years to improve microwave ovens in the area of energy distribution. In some cases, the food was placed on a turntable rotating within the cavity having hot spots or cold spots in an attempt to average out these undesired zones during cooking. Many ovens now utilize a rotating element in the manner of rotating fan blades in the feed system. The blades have irregularly shaped surfaces, which when rotated, normally by a motor, scatter the microwave energy to all parts of the cavity.

However, the versatility of microwave ovens in being able to cook food of various sizes, shapes, dielectric properties, and in a variety of cooking containers, alters the energy distribution within the cavity. Thus, while various improvements based on principles of microwave energy distribution can be incorporated, the final results of such changes must be subjected to actual cooking tests to determine whether such changes have resulted in an improved energy distribution or cooking pattern.

SUMMARY OF THE INVENTION

In accordance with the principles of the present invention, an improved feed system has been provided for a microwave oven. In testing this improvement, it has been found to provide a significant improvement in energy distribution or cooking pattern. In particular, the magnetron tube supplying microwave energy is mounted to a shelf which extends into but not more than half the distance between two opposing cavity walls, with the end of the shelf terminating adjacent a pair of rotating stirrer blades. The shelf end adjacent the stirrer blades includes a pair of adjacent arcuate sections. Each of the arcuate shelf sections conforms to the rotational arc circumscribed by the stirrer blades.

By experimentation it has been determined that clearance between the stirrer blades and the terminating arcuate sections of the shelf should be greater than 0.25 inch and less than 0.75 inch in order to obtain the best cooking performance. A tuning stub is mounted to the shelf portion projecting into the cavity. The tuning stub position, diameter and height may be adjusted in a manner well-known in the art to obtain maximum power output from the magnetron.

In an alternative embodiment of the invention, the portion of the shelf projecting into the cavity, which forms a waveguide launching section for the microwave energy, can be formed of a separate plate mounted to the interior of the microwave cavity and at a height level with the shelf supporting the magnetron. The plate size can either be attached to the two remaining opposed cavity walls or left unattached as desired. In another alternative embodiment of the invention, the launcher plate may be spacially mounted to the cavity wall adjacent the magnetron by means of a plurality of conductive spacer mounting elements.

All of the aforementioned embodiments were determined experimentally to provide equally successful cooking patterns of significant improvement over that of the prior art. Each embodiment incorporated the magnetron launcher shelf extending not more than halfway into the cavity with the free end terminating in arcuate sections corresponding to the arc circumscribed by the rotating stirrer blades, and with the clearance between the stirrer blades and the launcher edge being greater than 0.25 inch and less than 0.75 inch.

DETAILED DESCRIPTION

Figure 1:
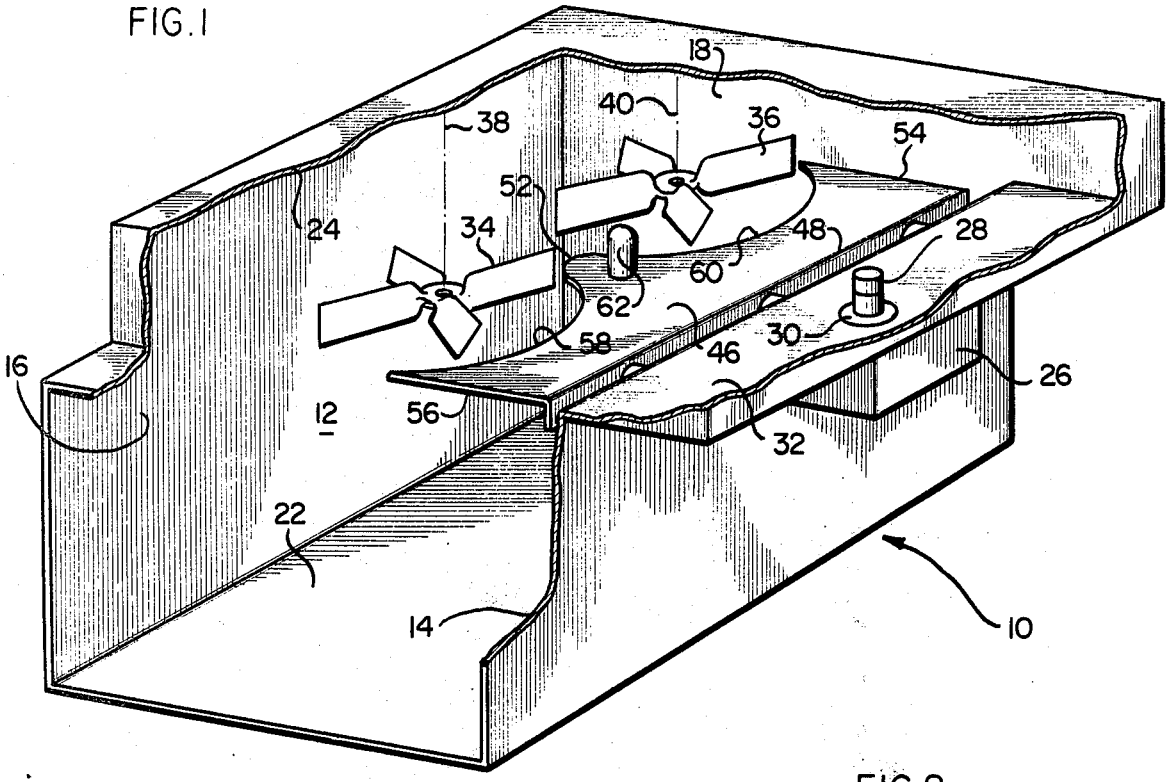
FIG. 1 is a perspective view of a portion of a microwave oven and illustrating an improved microwave oven feed section constructed in accordance with the principles of the present invention.

Referring now to FIG. 1, there is illustrated microwave oven apparatus 10 including a resonant microwave cavity 12 defined between respective opposite side walls 14, 16, 18, 20, bottom 22 and top 24. Items non-essential for this description have been omitted for clarity. That is, the ceramic shelf, door, choke seal, power supply, controller and outer wrap normally associated with a microwave oven have been omitted.

A microwave energy source 26 containing a magnetron tube supplies microwave energy to the cavity 12 through a radiating element 28 extending through aperture 30 in a mounting shelf 32. As can be seen most clearly in FIG. 1, the mounting shelf 32 extends transversely outwardly from wall 14 with respect to cavity 12 and provides means for mounting an enclosure containing the magnetron tube.

A pair of mode stirrers such as a pair of rotating fan-like stirrer blades 34 and 36 are located intermediate microwave cavity 12 and radiating element 28 so as to scatter the microwave energy throughout the cavity in a manner well-known in the art. The stirrer blades 34 and 36 may be rotated by means of suitable motors (not shown) drivingly connected to shafts coinciding with the respective axes of rotation 38, 40 in a manner well-known in the art. The stirrer motor may for instance be mounted above and to the top wall 24 with the respective drive shafts extending through the wall to coincide with the axes 38 and 40 and connect to the respective blades 34, 36. In the alternative, the blades 34, 36 may be rotated by a suitable air flow supplied from a blower in a manner well-known in the art. In any event, the outer perimeters of the stirrer blades 34 and 36 circumscribe circular paths 42 and 44 illustrated in the dashed lines of FIG. 2, and axes 38 and 40 are midway between cavity walls 14 and 16.

Figure 2:
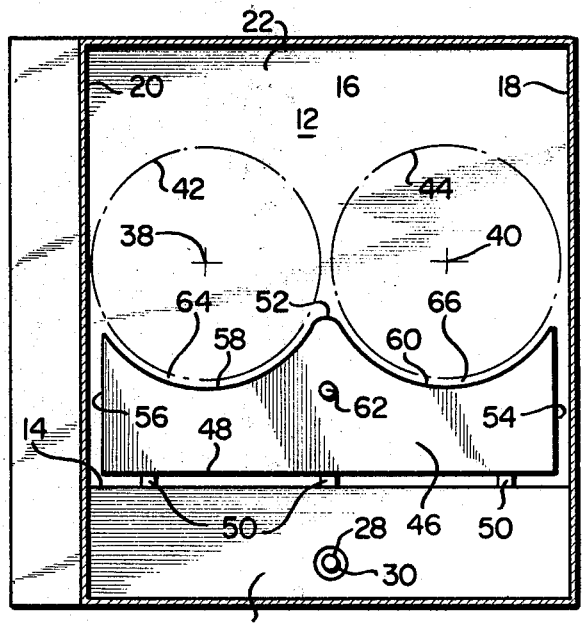
FIG. 2 is a plan view, partly in section of the microwave oven portion shown in FIG. 1.

An extension plate 46 of shelf 32 includes one end 48 mounted to cavity wall 14 by means of three metal spacers 50. Shelf extension 46 acts as a microwave launching portion aiding in feeding microwave energy from the magnetron to the cavity. Opposite end 52 of shelf extension 46 extends into cavity 12 and terminates before crossing the center line of the cavity defined between cavity walls 14 and 16 as illustrated in FIG. 2. Two other respectively opposite sides 54, 56 extend along and are substantially adjacent to respective cavity walls 18 and 20. The bottoms of stirrer blades 34 and 36 lie approximately in the plane of plate 46.

End 52 has a pair of circular cut-outs, specifically arcuate sections 58 and 60, matching the circular paths 42 and 44 circumscribed by the rotating stirrer blades. A tuning stub 62 is mounted by suitable means such as threads through an aperture provided in shelf extension 46 so that the height of the tuning stub above the shelf can be positionably adjusted. As is known, the tuning stub diameter and position on plate 46, along with the height adjustment of the stub, are experimentally determined so as to obtain maximum power output from the microwave energy source 26.

It has been found through experimentation that the improved feed section including the shelf extension 46 acting as a microwave launching portion provides a significantly improved cooking pattern when compared to the prior art. In particular, it has been determined that the clearance or spacial distance indicated by reference numerals 64, 66 between the stirrer blades and the arcuate perimeters 58, 60 should be greater than 0.25 inch and less than 0.75 inch to obtain the best cooking pattern performance.

Figure 3:
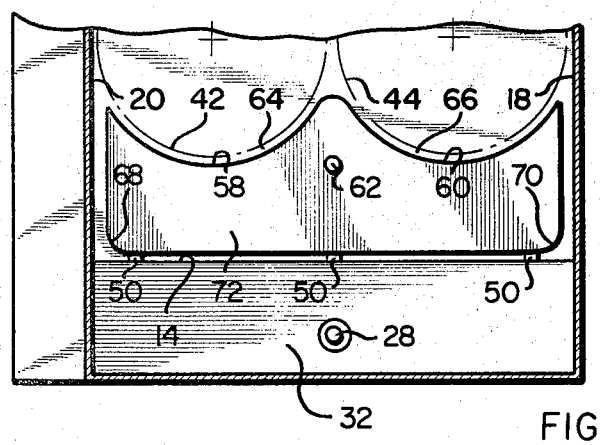
FIG. 3 is a fragmentary plan view, partly in section, illustrating an alternative embodiment of the improved feed system.
Figure 4:
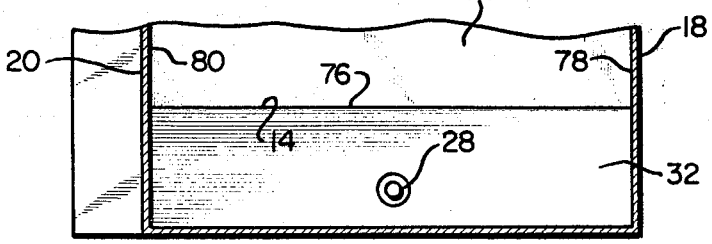
FIG. 4 is a fragmentary plan view, partly in section, illustrating another alternative embodiment of the present invention.

Two alternative embodiments of the improved microwave feed system of the present invention are illustrated in FIGS. 3 and 4. It has been determined experimentally that the use of these alternative embodiments results in microwave oven cooking patterns substantially identical to those obtained in connection with the embodiment shown in FIGS. 1 and 2. In particular, note that in FIG. 3 an edge radius 68 and 70 is provided in the modified launching plate or extension shelf 72. In FIG. 4, launching plate or shelf extension 74 includes sides 76, 78 and 80 which are mounted respectively to cavity walls 14, 18 and 20.

While not illustrated for purposes of convenience, it is to be understood that the alternative launching plate 74 also includes similar arcuate sections such as arcuate sections 58, 60 illustrated in connection with FIGS. 1-3. The arcuate sections 58 and 60 may be slotted or apertured to mount brackets supporting the stirrer blades, and as indicated previously, the blades may be rotated by an airstream directed against the blades. In any event, such modifications would normally require a compensating adjustment in the size and position of tuning stub 62 on the launching plate. This compensation can, of course, be readily provided by those skilled in the art.

While particular embodiments of the present invention have been shown and described, it will be obvious to those skilled in the art that various changes and modifications may be made without departing from the invention in its broader aspects. Accordingly, the aim of the appended claims is to cover all such changes and modifications as may fall within the true spirit and scope of the invention.

What is claimed is:

1. In a microwave oven including a microwave energy source coupled to a microwave cavity through a feed section, and a pair of rotating stirrer blades for distributing the microwave energy in said cavity, an improved feed section comprising:

a shelf extending from one wall of said cavity, including means for mounting said microwave energy source to said shelf and propogating microwave energy above said shelf into said cavity;

said shelf having a microwave energy launching portion extending from said one cavity wall towards an opposing cavity wall;

said launching portion not extending beyond one half the distance between said opposing cavity walls and terminating in adjacent perimeter sections each conforming to the respective paths traversed by said rotating stirrer blades.

2. The improvement according to claim 1, wherein said perimeter sections comprises adjacent arcuate sections conforming to the circular paths circumscribed by each of said rotating stirrer blades.

3. The improvement according to claim 1 including tuning means in said cavity for optimally coupling energy from said energy source to said cavity.

4. The improvement according to claim 3, wherein said tuning means are adjustable.

5. The improvement according to claim 4, wherein said adjustable tuning means includes a positionable tuning stub mounted to said launching portion.

6. The improvement according to claim 5, wherein said tuning stub includes threaded means for threadably positioning said tuning stub into said launching portion thereby adjusting the height of said stub above said launching portion.

7. The improvement according to claim 1, wherein said launching portion comprises a plate having a fixed end mounted to said one cavity wall.

8. The improvement according to claim 7, including mounting means for spacially mounting said fixed end to said one cavity wall.

9. The improvement according to claim 8, wherein said mounting means includes a plurality of conductive spacers spacially mounting said fixed end to said one cavity wall.

10. The improvement according to claim 7, wherein said plate includes a pair of opposing sides, and means for respectively mounting each of said sides to a respective one of the opposing, remaining cavity walls.

11. The improvement according to claim 1, wherein the distance between the path traversed by a rotating stirrer blade and the respective perimeter section is between about 0.25 inch and 0.75 inch.

* * * * *